US006710500B1

(12) United States Patent
Wagner et al.

(10) Patent No.: US 6,710,500 B1
(45) Date of Patent: Mar. 23, 2004

(54) COMMUTATION DEVICE, ESPECIALLY A COMMUTATOR, AND METHOD FOR PRODUCING SUCH A DEVICE

(75) Inventors: Armin Wagner, Oberrot (DE); Claudia Wisinger, Munich (DE); Dieter Michael Roth, Gartringen-Rohrau (DE); Michael Eigner, Leinfelden-Echterdingen (DE); Eckhard Konig, Ehningen (DE)

(73) Assignee: Kirkwood Industries GmbH, Herrenberg (DE)

( * ) Notice: Subject to any disclaimer, the term of this patent is extended or adjusted under 35 U.S.C. 154(b) by 0 days.

(21) Appl. No.: 09/856,851

(22) PCT Filed: Nov. 24, 1999

(86) PCT No.: PCT/EP99/09061

§ 371 (c)(1),
(2), (4) Date: May 25, 2001

(87) PCT Pub. No.: WO00/33428

PCT Pub. Date: Jun. 8, 2000

(30) Foreign Application Priority Data

Nov. 27, 1998 (DE) ..... 198 54 843

(51) Int. Cl.[7] ..... H01R 39/04; H01R 39/06
(52) U.S. Cl. ..... 310/233; 310/237; 29/597
(58) Field of Search ..... 310/233, 235, 310/236, 237; 29/597

(56) References Cited

U.S. PATENT DOCUMENTS

| | | | | |
|---|---|---|---|---|
| 2,486,875 A | | 11/1949 | Pollock | 310/236 |
| 2,519,626 A | | 8/1950 | Blair | 310/236 |
| 3,819,967 A | | 6/1974 | Binder | 310/236 |
| 4,845,395 A | | 7/1989 | Bost | 310/233 |
| 5,157,299 A | * | 10/1992 | Gerlach | 310/234 |
| 5,189,329 A | * | 2/1993 | Strobl | 310/233 |
| 5,584,115 A | * | 12/1996 | Takahashi | 29/597 |
| 5,629,576 A | | 5/1997 | Shimoyama | 310/237 |

FOREIGN PATENT DOCUMENTS

| | | | |
|---|---|---|---|
| AT | 170764 | 9/1951 | |
| AT | 311 482 | 3/1973 | H01R/39/16 |
| DE | 301410 | 10/1917 | |
| DE | 54 421 | 3/1967 | |
| DE | 1 992 099 | 8/1968 | |
| DE | 2 352 155 | 4/1974 | H01R/43/06 |
| DE | 117 770 | 1/1976 | H01R/39/04 |
| DE | 41 17 803 C 2 | 12/1991 | H01R/39/04 |
| DE | 295 00 984.5 | 5/1995 | H02K/7/116 |
| DE | 195 30 051 A 1 | 2/1997 | H01R/39/14 |
| DE | 195 43 998 A 1 | 5/1997 | H01R/43/06 |
| DE | 298 02 497 U 1 | 5/1998 | H01R/39/04 |
| EP | 0 127 801 A1 | 12/1984 | H01R/43/06 |
| EP | 0 361 860 A2 | 4/1990 | H01R/39/04 |
| EP | 0 510 233 A1 | 10/1992 | H01R/39/04 |
| FR | 2 614 475 | 10/1988 | H01R/39/04 |
| GB | 281860 | 12/1927 | |
| WO | 95/14319 | 3/1995 | H01R/43/06 |

* cited by examiner

*Primary Examiner*—Burton Mullins
(74) *Attorney, Agent, or Firm*—Roylance, Abrams, Berdo & Goodman, LLP

(57) ABSTRACT

A commutator, having extremely exact geometrical dimensions and a long-time stability and being easy to produce, includes a pre-shaped, substantially cylindrical support body with a rotational axis. Electrically conductive commutator segments are fixed on the support body by fasteners arranged substantially between the commutator and the segments. The support body and the segments are provided with interacting structures to position and adjust the segments relative to the support body.

15 Claims, 4 Drawing Sheets

COMMUTATION DEVICE, ESPECIALLY A COMMUTATOR, AND METHOD FOR PRODUCING SUCH A DEVICE

FIELD OF THE INVENTION

The present invention relates to a current reversal device, particularly a commutator, and to a process for production of such device. Such devices are employed in electric motors and current generators, for example, in tools powered by electricity, actuating drives, and fuel pumps.

BACKGROUND OF THE INVENTION

Generic current reversal devices are disclosed, for example, in DE 41 37 400 C2. In this patent, a composite segment is stamped from a rolled or drawn copper strip and then is roller burnished, split a short distance or scored, and sprayed with a compression molding compound forming the outer cover of the commutator after settling. The bore in the outer cover must then be machined. The clasps of the commutator segments must be bent for fastening the ends of the windings. After an additional scaling or stripping procedure, the commutators undergo electrical testing and are then mounted on the engine shaft by force fitting.

DE 195 30 051 A1 discloses a plug-in commutator in which the commutator segments are inserted into an assembly cage and then sprayed with molded plastic material to form the outer cover. These operations are followed by additional machining and testing steps carried out to comply with the requirements set for accuracy of the geometric dimensions of the commutator and for the stability of the commutator.

DE-OS-2 352 155 discloses a commutator for a miniature electric motor and a process for manufacture of this motor. A desired number of commutator plates are fastened on a jacket surface of a core in specific sectors by an adhesive.

WO 95/14319 discloses a commutator and a process for its manufacture in which the segmented receiving means are undersized. The insulating elements and/or the segments have an elasticity such that the segments inserted into the segment receiving means are fastened both by form locking and by force locking. In addition, the segments may be caulked or cemented to the outer cover.

U.S. Pat. No. 3,819,967 shows a drum commutator in which the commutator segments are fastened to the cylindrical outer cover by cementing.

EP 0 361 860 A2 discloses a commutator in which the segments are fastened on the outer cover with an adhesive layer inserted between them. In addition, the segments are bent, at least on one end, to form a clasp. The segments are engaged in an incision in the outer cover which recedes radially from the circumferential surface of the outer cover and extends axially.

The metal segments are oxidized on the surface of their interior narrow side and then bonded to the ceramic body by being heated to the temperature required for production of a eutectic.

U.S. Pat. No. 5,629,576 discloses a planar commutator with commutator segments containing carbon. The segments are fastened to connection means of copper by an adhesive bonding agent. A segment is oriented toward the connection means by way of a recess in the segment containing carbon into which the bonding agent is also introduced.

Conventional commutators require a large number of production and testing steps in order to make it possible to guarantee the required degrees of accuracy and reliability.

SUMMARY OF THE INVENTION

Objects of the present invention are to provide a commutator exhibiting high accuracy with respect to its geometric dimensions and high long-term stability, while being simple to manufacture.

The segments may be fastened on the outer cover by fastening means mounted more or less between the outer cover and the segments. The outer cover is generally made from an electrically insulating material, particularly of a plastic such as a duroplastic, a thermoplastic, or of a ceramic material. Consideration may be given, as an alternative, to a metal outer cover such as one of aluminum whose surface is provided with a preferably electrically insulating coating such as a coating of varnish or a layer of metal oxide produced by oxidation of the metal outer cover. The outer cover may also be built up in two or more layers, and especially, may have a flexible internal hub surrounded by a temperature-stable outer shell on which the segments may be fastened. The flexible internal hub provides the necessary force fitting for mounting the commutator on an engine shaft. The commutator segments generally comprise copper or a copper compound. Consideration may be given also to other materials in keeping with the requirements set for conductivity, temperature stability, and chemical resistance. The fastening means is preferably applied in layers between the segments and the outer cover, and may be applied prior to fastening on the outer cover and/or the segments.

The outer cover and the segments have interacting means for positioning and orienting the segments relative to the outer cover. They may be made in the form of punctiform, linear, or planiform projections and matching recesses on the outer cover or on the segments. The segments, for example, may have studlike projections which may be inserted into matching grooves oriented parallel to the axis of rotation on the circumference of the outer cover. In the case of a planar commutator, radially oriented studs on a frontal surface may fit into corresponding recesses or grooves on the pertinent segment; or the cylindrical outer cover may have on the edge on its front side an axially projecting and preferably circumferentially annular continuous projection to ensure centering of the disk segment to, be fastened on the front surface. The disk segment may then be divided into individual commutator segments electrically insulated from each other.

If the fastening means is a layer of adhesive, this layer may be filled with suitable additive meeting electric and/or thermal requirements. The thermal coefficient of linear expansion of the adhesive layer, for example, can be reduced by a ceramic filler. If required, an electrically conductive metal filler, such as one based on Ag, Cu, or Ni may be used to establish a connection between the segment and the outer cover, for example, if the outer cover for a planar commutator comprises electrically conductive segmental connecting lines. The fillers may in particular define a distance between the commutator segments and the outer cover, and thus, the thickness of the adhesive layer, preferably by means of spherical fillers, especially ones in the form of glass or ceramic spheres. The layer thickness ranges, for example, from 20 to 250 $\mu$m, and preferably from 50 to 100 $\mu$m. The layer thickness may also be determined in advance by means of spacers, preferably in one piece, made up of the outer cover or the commutator segments, as for example by punctate, linear, or planiform projections. The adhesive to be selected or treated will absorb as little moisture as possible after setting, will form a permanent strong bond with copper in particular and is dimensionally stable when subjected to mechanical and/or thermal stress.

If the fastener is a soldered or welded layer, the commutator possesses particularly high temperature stability and chemical resistance. Consideration is given in this case preferably to low melting soft, hard, or glass solders, such as low melting lead/tin solders or glass solders with a high lead oxide content. An especially low bonding temperature is obtained by ultrasound or friction welding.

If the segments and the outer cover have force fitted interacting anchor and receiving means, the segments may be inserted into the outer cover. The spring loaded anchor and receiving means operating in opposition to each other form a sufficiently stable clamp connection. In addition, the segments on the outer cover may be positioned by the bonding means. It is also possible, however, to dispense with an additional bonding agent and to position the segments exclusively with anchor and receiving means forming a clamp connection. Both the segments and the outer cover may have only anchor means or only receiving means or a combination of anchor and receiving means. The sole essential requirement is that anchor or receiving means of the segment interact with receiving or anchor means of the outer cover.

It is especially advantageous to be able to insert or clip the segments radially into the outer cover, as for example in the case of a drum commutator, or to insert them axially into a frontal surface of the outer cover, in the case of a planar commutator, for example.

It is also advantageous for the positioning and orienting of the segments to take place simultaneously with insertion of the segments into the outer cover by means of the anchor or receiving means. Means for positioning and orienting extend preferably parallel to the axis of rotation along a peripheral surface or radially to the axis of rotation along a frontal surface of the outer cover. All suitable configurations, in particular studs which are triangular, rectangular, hemispherical, or swallow-tailed in cross-section, may be considered as positioning and orienting means. Cross-sectional shapes which widen out in depth, and especially ones provided with a point for ease of insertion, are particularly well suited for anchoring.

In the process of the present invention, segments are fastened to the outer cover by means of a bonding agent mounted more or less between the outer cover and the segments. For example, the outer cover as a whole may be immersed in a bonding means bath before the segments are fastened. Alternatively or in addition, at least the surface of the segments facing the outer cover may be provided with the bonding means. Optionally, the surfaces of the outer cover and/or of the segments are to be cleaned and/or provided with a bonding agent before the fastener is applied. The surfaces may by preference be conditioned in a vacuum process, such as in an ion or plasma vacuum process. Surface treatment may also be carried out to achieve adequate aging and corrosion resistance of the fastening layer to stresses during subsequent use and/or uniform wetting means with the fastener. Secondary treatment of the bonded joint is also advantageous in cementing, in particular, to prevent corrosion and/or infiltration, and so reduction of the strength of the fastening.

Means for positioning and orienting the segments are provide whose shape is such that positioning and orienting take place automatically as the segments are delivered. For example grooves triangular in cross-section in the outer cover can be used, into which studs of the segments of matching cross-section are introduced. In this case, the fastening means may be introduced into the groove, for example, as a line of adhesive, before delivery. As the segments are subsequently delivered, the fastening means is displaced to form a flat bonding layer between outer cover and segment.

If a clamp connection is established between anchor and receiving means, fastening means introduced between the outer cover and the segments may be omitted. In this instance, fastening is effected exclusively by means of anchor and receiving means forming part of a clamp connection.

If the fastening means is provided, an adhesive, solder, or weld layer is to be considered in particular for this purpose. The maximum temperature in additional treatment may be around 300° C. for a brief period. Setting of an adhesive layer should always take place at the lowest possible temperature, for example, in the temperature range from 50 to 250° C., preferably from 170 to 200° C.

If the segments are delivered to the outer cover sequentially, this may be effected by step-by-step rotation of the outer cover around its axis of rotation and application of the segments piece by piece, or by rolling of the outer cover onto the segments interconnected in a strip, for example. In the case of step-by-step delivery, the connection between the outer cover and the pertinent segment may be established either immediately after delivery or as the final step for all segments delivered together, for example, by surrounding the outer cover with segments in place with compression and/or heating tongs.

If all segments are delivered to the outer cover simultaneously, this may be accomplished with a suitable compression and/or heating tool. Following delivery, the tool ensures mechanically reliable fastening of the segments to the outer cover. It may be effected, for example, by pressing the segments into the outer cover, in particular by pressing the anchor and receiving means together and/or by heating the segments to the point of melting of the fastening means and production of a bonding layer.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF THE INVENTION

Figure 1:
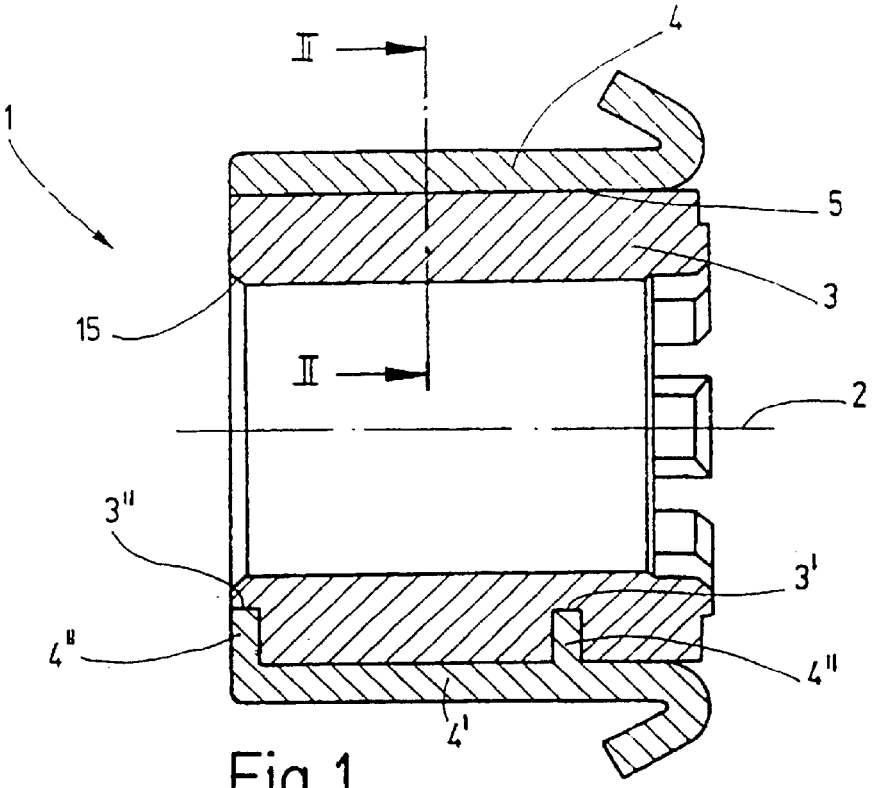
FIG. 1 is a side elevational view in section of a commutator according to an embodiment of the present invention.

FIG. 1 illustrates commutator 1 according to the present invention. The more or less cylindrical outer cover 3 has an axis of rotation 2, and preferably is formed of a thermoplastic or duroplastic, such as a hollow cylinder of phenol resin produced by hot casting. Electrically insulated from each other over the circumference on the cylindrical outer wall and preferably containing copper or a copper compound are segments 4. The segment ends are bent to form a hook for connection of the accompanying coil winding (not shown). The segments 4 are secured by fastening means 5 mounted more or less between the segments and the outer cover 3. In the illustrated embodiment, the fastening means is an adhesive layer of epoxy resin, polyurethane resin, or phenol resin.

Shown in the lower half of FIG. 1 is a second commutator segment 4' having two anchor means 4" oriented radially as one piece. Such anchor means increases the stability of fastening of the second segment 4' on the outer cover 3, and simultaneously performs the function of positioning and orienting the second segment 4'. The anchor means 4" engages corresponding recesses in the outer cover. The recesses may be in the form, for example, of circumferential annular grooves 3' or circumferential annular shoulders 3".

Fitted on the outer cover 3 is a cone 15 which simplifies sliding of the outer cover 3 onto an engine shaft (not shown).

Figure 2:
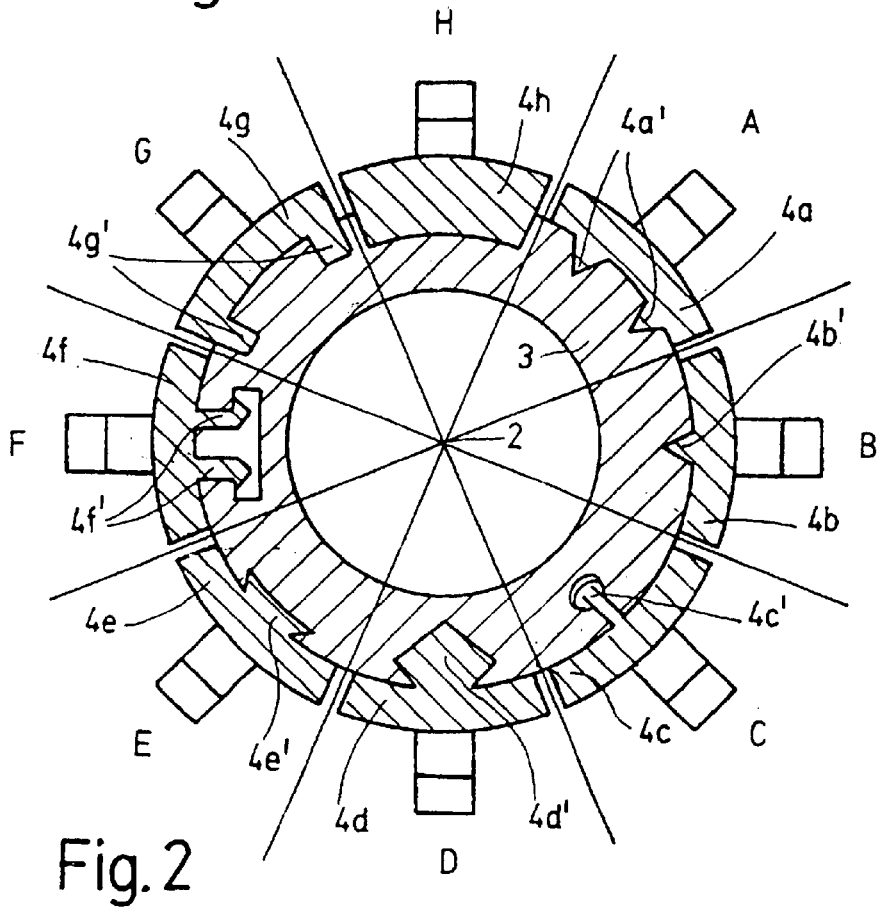
FIG. 2 is an end elevational view in section of the commutator taken along line II—II of FIG. 1 showing various embodiments.

FIG. 2 shows various embodiments of means for positioning, orienting and anchoring segments 4 on the outer cover. In figure section 2A, segment 4*a* has two studs 4*a'* triangular in cross-section and extending parallel to the axis of rotation 2 (perpendicular to the plane of the drawing). These studs are either pressed into the outer cover 3 by application of force and/or under the influence of temperature or are inserted into suitably shaped grooves in the outer cover 3.

Figure Section 2B shows a segment 4*b* with a single central stud 4*b'* also triangular in cross-section and extending parallel to the axis of rotation 2.

Figure section 2C shows a segment 4*c* with an anchor element 4*c'* which initially extends as a stud and has on its end oriented toward the axis of rotation a thickened area more or less circular in cross-section. The anchor means 4*c'* may extend parallel to the axis of rotation 2 in the form of a study over a part or over the entire axial length of the outer cover 3. Alternatively, the stud may be punctate, in the form of a mushroom, for example. In either case, the anchor means 4*c'* fits into a corresponding recess in the outer cover 3. The outer cover is elastically deformed in this area and applies a clamping force ensuring stable fastening of segment 4*c*.

Figure section 2D with segment 4*d* and anchor means 4*d'* and figure section 2E with segment 4*e* and anchor means 4*e'*, show dove tail anchors, in cross-section, which anchors may be in virtually any configuration desired.

Anchor means 4*f* in figure section 2F, preferably forming a single piece with segment 4*f*, is configured form the viewpoint of geometry and material so that it is deformed initially when segment 4*f* is pressed into the outer cover 3. When fully inserted, the anchor means fits into a more or less T-shaped recess in the outer cover 3. In this embodiment as well elastic deformation of the outer cover takes place in the area engaged. Such deformation applies the clamping force required for segment 4*f*.

Figure section 2G shows a segment 4*g* bent radially on its longitudinal sides or suitably shaped. The two sides 4*g'* either fit into corresponding recesses in the outer cover 3 or cut into them as a result of application of force.

Figure section 2H shows a segment 4*h* with a cross-section in the form of a circular segment. The segment is inserted into a corresponding recess in the outer cover 3.

Figure sections 2A to 2H show only a selection of the large number of the positioning, orienting, and anchoring options for the segments 4 on the outer cover 3. The anchor means on the outer cover 3 and corresponding recesses or receiving means in the segments may, of course, be analogously shaped. In addition or as an alternative to the anchor means, fastening may also be effected by a bonding layer, such as an adhesive, solder, or weld layer.

Figure 3:
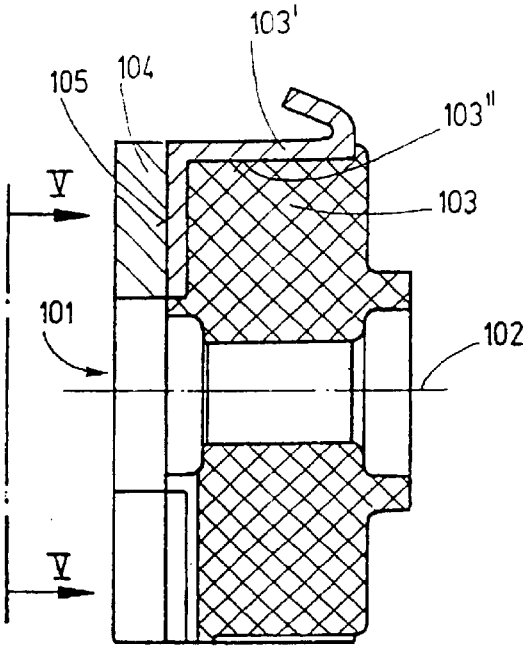
FIG. 3 is a side elevational view in section of a planar commutator, taken parallel to the axis of rotation according to an embodiment of the present invention.

FIG. 3 shows a planar commutator 101, with an outer cover 103 having an axis of rotation 102. Electric connection means 103' are provided for connection of the coil windings which are to establish contact with segments 104 fastened on the frontal surface of the outer cover 103. If the outer cover 103 is formed of an electrically insulating material, the connection between the outer cover 103 and the electric connection means 103' may be made in the form both of an electrically insulating and an electrically conducting bonding layer 103", such as an adhesive, solder, or welded layer. On the other hand, the connection 105 between electric connecting means 103' and segments 104 is to be established in all cases by means of an electrically conductive bonding layer 105, as for example by means of an adhesive layer filled with metal particles. The electric connection means 103' may initially be in the form of a copper cup spray coated, preferably with a duroplastic to form the outer cover 103. Circular segment disk 104, preferably, is formed of carbon or containing carbon, and is fastened on the preformed outer cover 103 by means of bonding layer 105. Electric insulation of the commutator segments is then effected by means of cuts through the segment disk which are radial relative to the axis of rotation 102 through segment disk 104 and through the frontal bottom surface of the copper cup of connecting means 103'.

Figure 4:
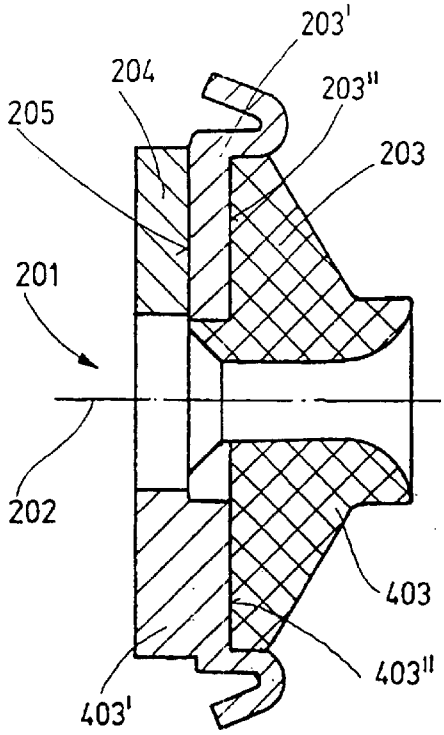
FIG. 4 is a side elevational view in section of a planar commutator according to other embodiments of the present invention.

FIG. 4 illustrates another planar commutator 201 with an axis of rotation 202 and with a bar-shaped connection means 203' which is a component of the outer cover 203. The bonding layer 205 between connection means 203' and carbon disk 204 is electrically conductive. The bonding layer 203" between connection means 203' and the outer cover 203 may be either electrically insulating or electrically conductive. An alternative embodiment of a copper planar commutator in which the copper planar segments 403' are fastened to an electrically insulating or electrically conductive adhesive layer 403" on the outer cover 403 is illustrated in the lower half of FIG. 4.

Figure 5:
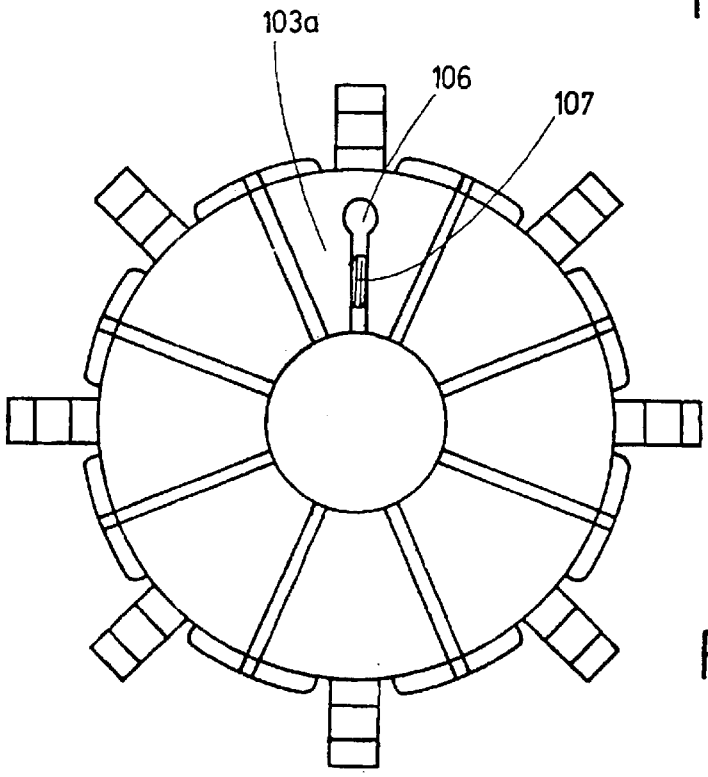
FIG. 5 is a front elevational view of the planar commutator taken along line V—V of FIG. 3.

FIG. 5 presents a view of the frontal surface of the planar commutator over section V—V in FIG. 3 with carbon disk 104 not yet fastened. In a segment area 103*a*, a bottom surface of the cupshaped connection means 103' has a recess 106 shaped as a keyhole. A matching pin-shaped or stud-shaped projection 107 of a preformed outer cover core may be inserted into recess 106. In this way, the connection means 103' may be fastened on the preformed outer cover core as an addition or as an alternative to bonding layer 103" to exert a clamping effect.

Figure 6:
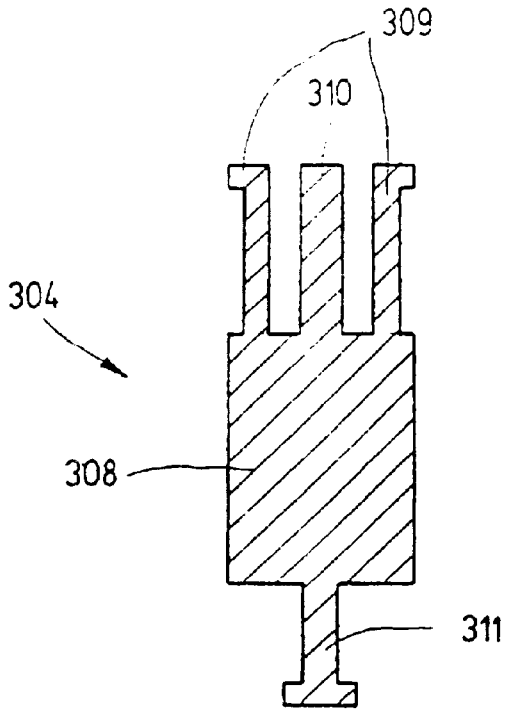
FIG. 6 is blanked out flat commutator segment according to the present invention.

FIG. 6 shows a punched out flat segment 304 of copper for a drum-type commutator. Segment 304 comprises a rectangular segmental surface 308. From one narrow side of surface 308, two external positioning and orienting means 309 and a central stud 310 project. Stud 310 is provided for connection of the coil winding. A positioning means 311 is formed on the opposite narrow side. Each of positioning means 309 and 311 has a projecting lug on its end.

Figure 7:
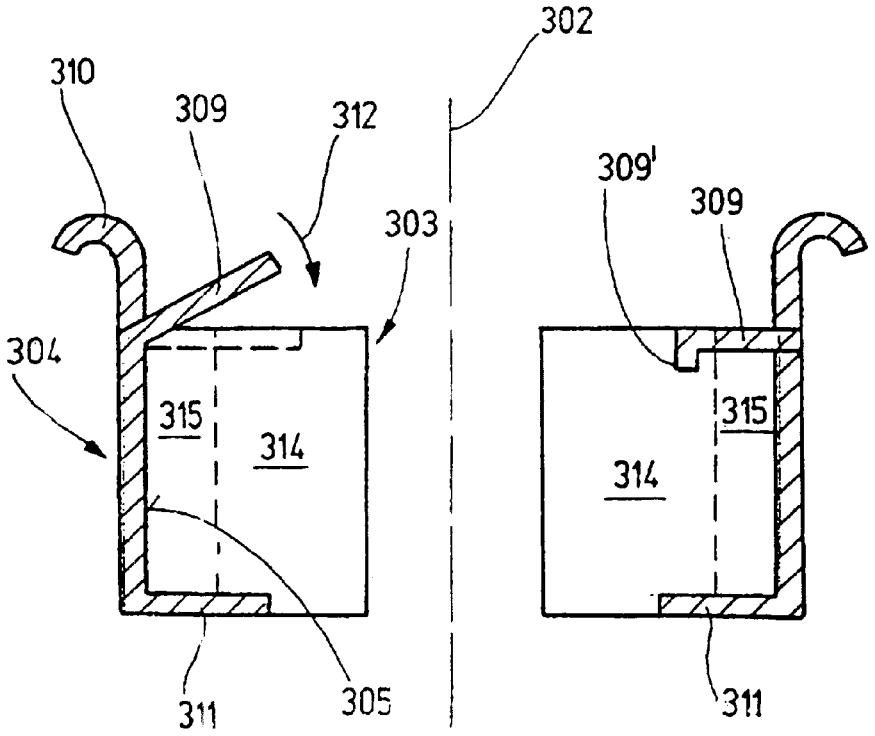
FIG. 7 is a side elevational view in section illustrating a method of assembling the segment of FIG. 6.

After the segment 304 has been provided with curvature matching that of the outer cover, the positioning means 309 and 311 are bent to an angle of approximately 90° relative to segmental surface 308 in the direction of the arrow 312, as illustrated in FIG. 7. The bent positioning means 309 and 311 are introduced into corresponding receiving means in the outer cover 303 and are thereby positioned and oriented. Segment 304 may be fastened on outer cover 303 exclusively by clamping between positioning means 309 and 311 and the outer cover 303, or alternatively or additionally by a bonding layer 305. The outer cover 303 is formed, for this purpose, exclusively of a flexible core 314 which exerts a flexible clamping effect on segments 304 or positioning means 309 and 311 and force fitting on the engine shaft (not shown). Externally, the outer cover 304 has an outer shell 315 which extends radially relative to the axis of rotation 302 and is form and temperature stable. The right half of FIG. 7 illustrates an alternative option of bending the positioning means 309, in which repeated bending forms a clasp 309' inserted into a matching recess in core 314. Similarly, (by a process not shown) the positioning means 311 on the opposite side may be inserted as a clasp.

Figure 8:
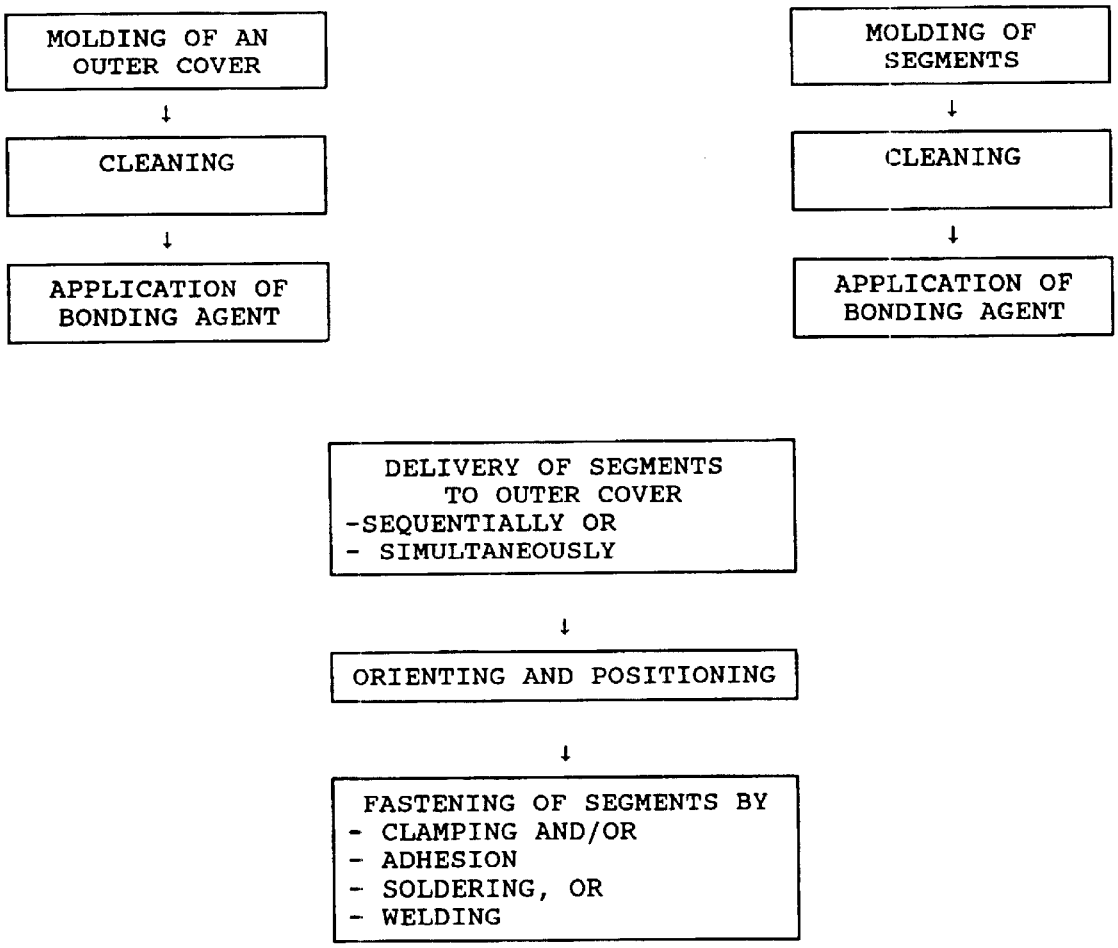
FIG. 8 is a flow chart of the process according to the present invention.

A flow chart illustrating the production process is presented in FIG. 8. Shaping of the outer cover and of the pertinent segments proceeds in parallel. Both the outer cover and the segments are preferably cleaned with suitable solvents or cleaning agents before being placed in position. If necessary, a bonding agent is applied. Positioning of the segments on the outer cover may be carried out sequentially or simultaneously. In any event, during the delivery, the segments are oriented and positioned relative to the outer cover. Lastly, the segments are fastened on the outer cover by clamping, adhesion, soldering, or welding. Adhesion, soldering, or welding may be provided as an alternative or supplement to clamping.

While various embodiments have been chosen to illustrate the invention, it will be understood by those skilled in the art that various changes and modifications can be made therein without departing from the scope of the invention as defined in the appended claims.

What is claimed is:

1. A commutator, comprising a preformed, generally cylindrical outer cover having an axis of rotation, a jacket surface, a front surface and a back surface;

electrically conductive current reversal segments fastened on said outer cover, said segments having segmental surfaces resting on said jacket surface and having first and second opposite ends;

bent, planar positioning members extending from said opposite ends, two of said positioning members having lugs extending at a right angle from ends of said positioning members remote from said segmental surface and extending over a plane of said front surface;

a stud extending from one of said ends providing a coil winding connection; and corresponding recesses on said front and back surfaces receiving said positioning members;

whereby said positioning members and said corresponding recesses interact for positioning and orienting said segments on said outer cover.

2. A commutator according to claim 1 wherein said segments are fastened on said outer cover by a bonding layer between said segments and said outer cover.

3. A commutator according to claim 2 wherein said bonding layer is an adhesive layer selected from the group consisting of epoxy resin, polyurethane resin and phenol resin.

4. A commutator, comprising a preformed, generally cylindrical outer cover having an axis of rotation and a core;

a cup-shaped connector having a frontal member with a keyhole-shaped recess and mounted on said outer cover;

electrically conductive current reversal segments fastened on said connector with said connector mounted between said segments and said outer cover by a bonding agent; and a projection on said core corresponding to and received in said recess to fasten said connector to said core by a clamping action.

5. A commutator according to claim 4 wherein said bonding agent is an insulating bonding layer.

6. A commutator according to claim 4 wherein said bonding agent is an electrically conductive bonding layer.

7. A commutator according to claim 6 wherein said bonding layer is selected form the group consisting of adhesive, solder or welding material.

8. A commutator according to claim 4 wherein said segments comprise a carbon containing circular segmental disk fastened by a bonding agent on a surface of said frontal member of said connector remote from said outer cover, said disk being isolated into said segments by cuts in said disk extending radially relative to said axis of rotation.

9. A commutator according to claim 8 wherein said bonding agent is a soldered layer.

10. A commutator according to claim 9 wherein said soldered layer is selected from the group consisting of soft, hard and glass solder layers.

11. A commutator according to claim 8 wherein said bonding layer is a welded layer.

12. A commutator according to claim 11 wherein said welded layer is selected form the group consisting of ultrasound, friction and electrode welded layers.

13. A process for manufacturing a commutator, comprising the steps of:

performing a generally cylindrical outer cover;

delivering a plurality of electrically conductive current reversal segments simultaneously to the outer cover;

fastening the segments to the outer cover, with segmental surfaces of the segments resting on a jacket surface of the outer cover;

positioning and orienting said segments on said outer cover by receiving bent, planar positioning members extending from opposite ends of said segments in corresponding recesses on front and back surfaces of the outer cover; and forming a stud extending from one of the ends of the segments to provide a coil winding connection.

14. A process for manufacturing a commutator, comprising the steps of:

preforming a generally cylindrical outer cover;

mounting a cup-shaped connector having a frontal member with a keyhole-shaped recess on the outer cover;

fastening a plurality of electrically conductive current reversal segments simultaneously on the connector with the connector being mounted between the segments and the outer cover by a bonding agent; and receiving a projection on a core of the outer cover in the recess to fasten the connector to the core by a clamping action.

15. A process according to claim 14 wherein all of the segments are delivered simultaneously to the outer cover.

* * * * *